United States Patent [19]

Walker, Jr.

[11] 3,965,914

[45] June 29, 1976

[54] COMMERCIAL DISHWASHER PRE-WASH STATION

[76] Inventor: James H. Walker, Jr., 4928 Salem Drive, Nashville, Tenn. 37211

[22] Filed: Feb. 6, 1975

[21] Appl. No.: 547,489

[52] U.S. Cl. ..... 134/104; 134/144; 134/154

[51] Int. Cl.[2] ..... B08B 3/02

[58] Field of Search ..... 134/82, 104, 126, 144, 134/154, 165, 172, 198, 201

[56] References Cited

UNITED STATES PATENTS

| | | | |
|---|---|---|---|
| 1,111,445 | 9/1914 | Dunton | 134/172 X |
| 1,557,179 | 10/1925 | Masonick | 134/82 |
| 2,971,520 | 2/1961 | Motis et al. | 134/172 |
| 3,099,585 | 7/1963 | Kahn | 134/104 X |
| 3,334,567 | 8/1967 | Benson | 134/198 |
| 3,717,159 | 2/1973 | Caviccioli | 134/104 X |

*Primary Examiner*—Robert L. Bleutge
*Attorney, Agent, or Firm*—I. C. Waddey, Jr.

[57] ABSTRACT

The invention disclosed herein is a structure for use as a pre-wash station for commercial dishwashing systems which is adapted for use with existing dishwashing systems. The structure includes a basin with a slanted bottom to allow the drain of waste material from the basin and includes a rack for supporting dishes which have been stacked in a carrier and which are to be processed at the pre-wash station. The rack has large openings to allow the waste material to fall into the basin as the dishes pass through the pre-wash station. One end of the basin is designed with a lip which will attach into the opening of the commercial dishwasher with which the pre-wash station is used and which has an edge positioned in such relationship to the rack so that when the carrier holding the dishes is moved from the pre-wash station into the dishwasher, the edge will scrap any waste materials off the bottom of the carrier.

4 Claims, 4 Drawing Figures

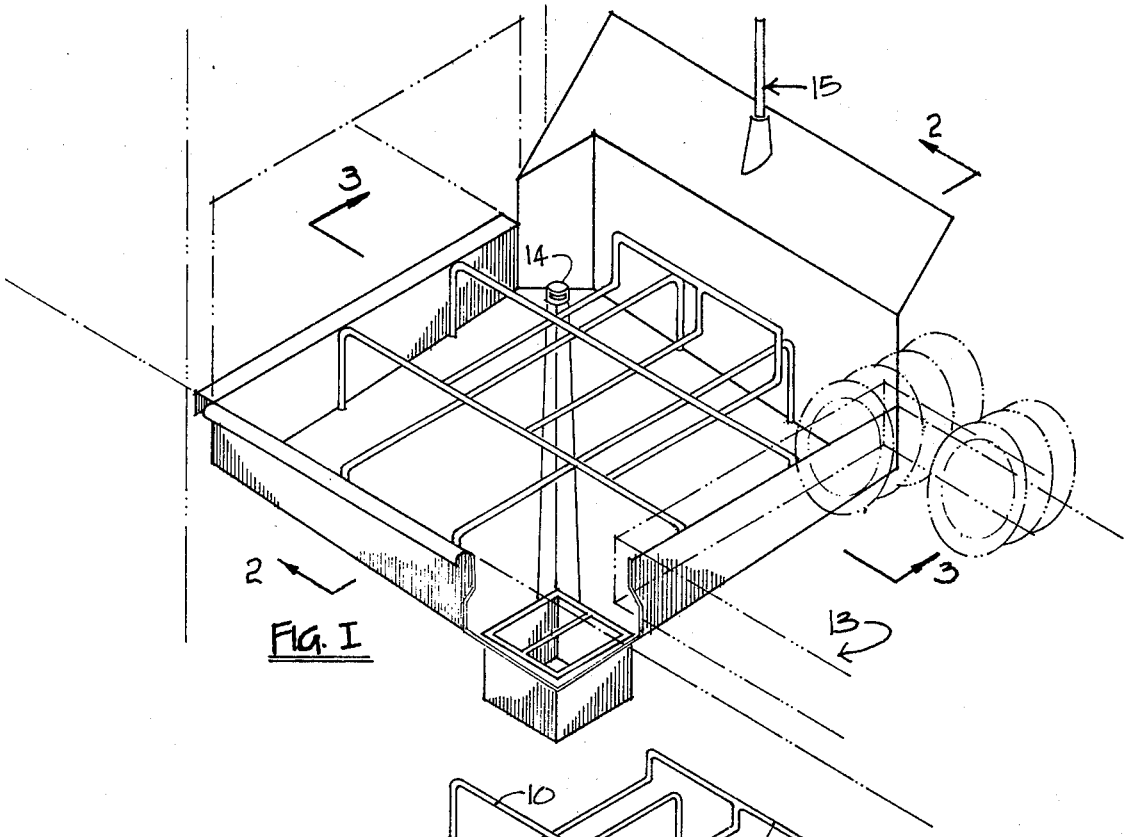
FIG. I
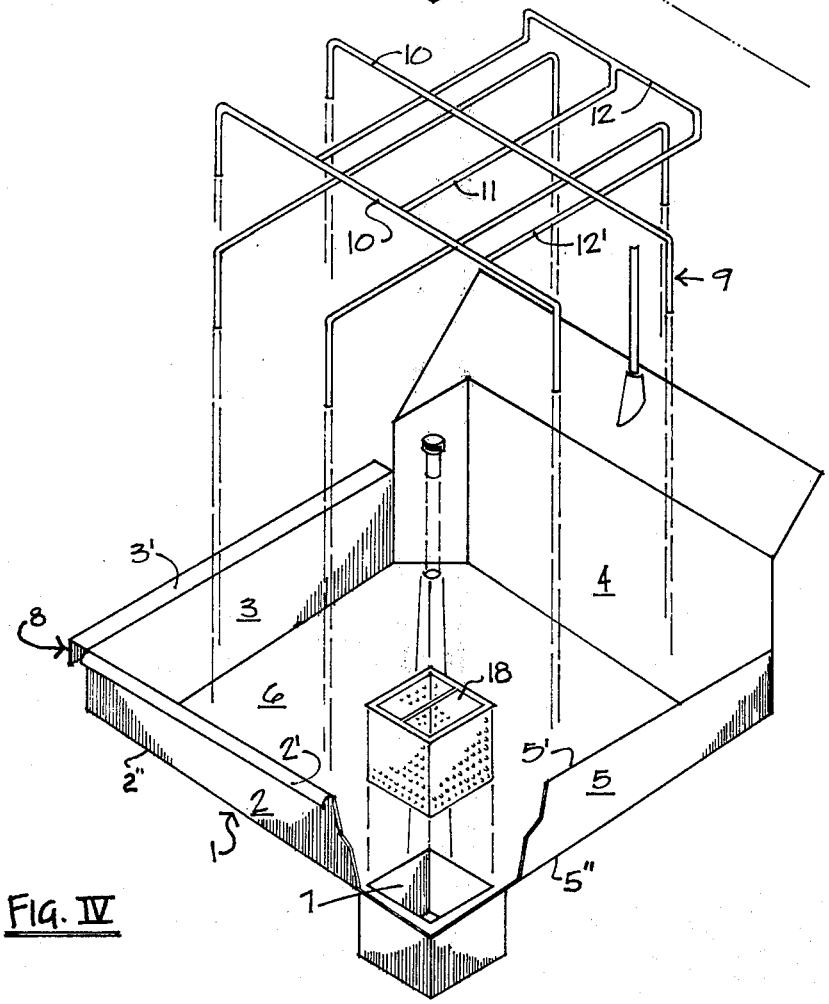
FIG. IV

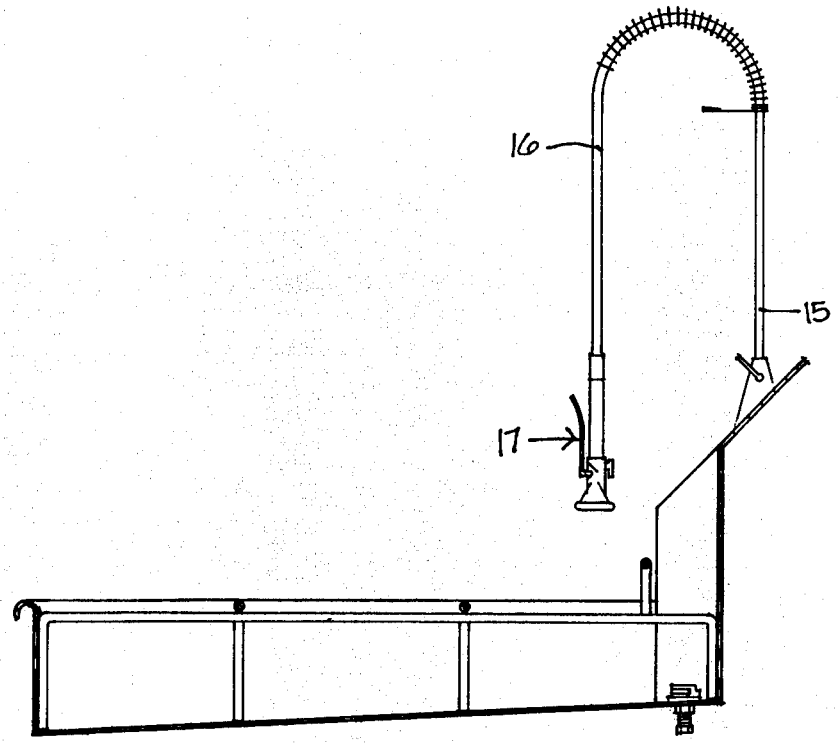
FIG. II
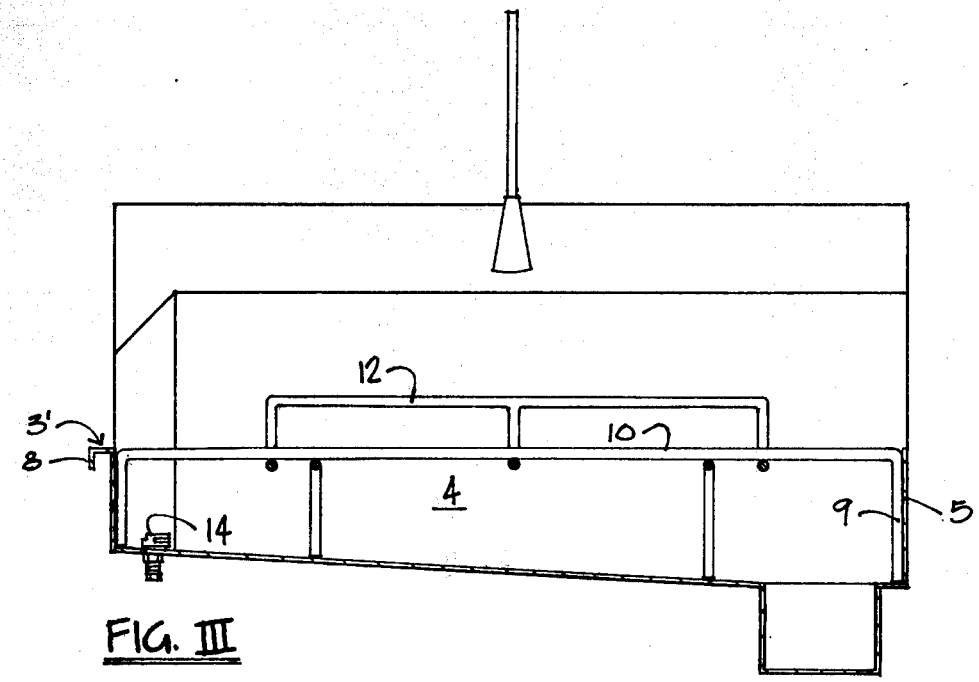
FIG. III

COMMERCIAL DISHWASHER PRE-WASH STATION

My invention relates to the field of commercial dishwashing operations, and more particularly to an improvement in equipment for the manual scraping and pre-washing of soiled dishes prior to their entering the wash chamber of the dishwashing machine.

State and local health requirements for restaurants and other commercial establishments involved in food preparation services require that all dish and cookingware be pre-washed prior to entering the wash chamber of a commercial dishwashing machine. The prior known methods for achieving this pre-wash are (1) a section of a large dishwashing machine is designed to provide a pre-wash function by forced spraying the ware with fresh or recirculated water in a separate compartment prior to entering the wash chamber of the dishwashing machine; (2) the individual pieces of dish or cooking ware are flushed with a stream of water prior to being placed in to carriers which hold the ware as it passes through the commercial dishwasher; or (3) after bulk scraping, the ware is placed in a dish carrier and then positioned in a pre-wash sink where the ware is flushed with a forced spray to remove any soil that may be stuck thereto.

The most common of the prior art systems in commercial use is the use of a pre-wash sink as an integral portion of the dish table with the dish table being a part of an assembly-type operation which allows the dishes stacked in the dish carrier to be passed along an assembly line and eventually into the commercial dishwashing machine. One of the disadvantages of the prior art dish tables and pre-wash stations is that the dish table is normally a horizontal plane with a slope toward the dishwashing machine to prevent liquids from collecting in place on the dish table. This causes soil that is scraped or flushed from the dishes to flow along the dish table and into the dishwashing machine, thus causing clogging of the dishwashing machine, requiring the useuse of greater amounts of detergent, and similar disadvantages. In addition, the structure of these prior art dish tables and the pre-wash stations that have been used with these dish tables is such that the carriers that carry the dishes into the dishwashing machine slide along the dish table with a plane of the carrier sliding along the dish table and acting as a scrape to push waste and soil that has been washed off the dishes directly into the dishwashing machine.

One of the objects of the present invention is to overcome the disadvantages of the prior art dish table, pre-wash station, combinations just discussed.

Another object of the present invention is the production of a pre-wash station that can be set up immediately adjacent the opening to the commercial dishwasher without the disadvantage of having the pre-wash station force scrape material into the commercial dishwasher.

Another object of the invention is the construction of a pre-wash station which can be maintained in a sanitary condition at all times, with a limited amount of effort on behalf of the operator.

Another object of the invention is to produce a pre-wash station for commercial dishwashers which can be constructed at a minimum expense.

Other objects and advantages of the invention will be apparent from the following description, the accompanying drawings, and the appended claims.

In the drawings:

FIG. 1 is a perspective view of the pre-wash station of my invention;

FIG. 2 is a horizontal section taken along the line 2—2 of FIG. 1, showing in detail the novel pre-wash station of my invention;

FIG. 3 is a horizontal section taken along the line 3—3 of FIG. 1, showing yet additional details of the invention, and FIG. 4 is another perspective view showing certain features of the invention in exploded detail.

Referring to the drawings, which illustrate the preferred embodiment of the invention, in FIG. 1, there is a perspective view of the pre-wash station of my invention. The station includes a basin referred to generally as 1 which includes the vertical side walls 2, 3, 4, and 5, which walls may be formed either separately or from a single molded piece of material. The bottom 6 of the basin is integral with the lower edge of each of the side walls 2, 3, 4, and 5. Each of the side walls 2, 3, and 5 have an upper edge 2′, 3′, and 5′, forming a horizontal plane. The bottom edge of the two walls, 2 and 5, 2″ and 5″ respectively, are askew with the top edge of these walls, 2′ and 5′ respectively. The structure thus fabricated results in the bottom 6 of the basin having a slant as compared to the plane of the upper edges of the side walls, and the bottom of the basin is askew with the said plane, so that when the pre-wash station is set in position, any liquid coming into the basin would tend to drain into the outlet 7 contained in the bottom of the basin. The outlet 7 may include a strainer basket in which to collect waste material rinsed from dishes placed in the pre-wash station. Alternatively, a channel (not shown) may be formed at the lower portion of the basin with the waste material flowing through the channel to an opening connected to a commercial garbage disposal.

The edge 3′ of the vertical wall 3 has a turned-down lip 8 which is designed to clamp onto the edge of the entrance opening of a commercial dishwashing unit. The upper edge 5′ of the vertical wall 5 may be either connected to a standard dish table, or the prewash station may be integral with a dish table assembly at that point.

The upper portion of the vertical wall 4 acts as a backsplash, and it is one feature of the present invention to have a backsplash of a height substantially equal to the front-to-back depth of the basin so that the operator of the pre-wash station may use the full water pressure of the spray assembly without fear of splashing waste material behind the pre-wash station which would otherwise result in an increase in clean-up time and effort.

Sitting within the basin 1 is a rack assembly which preferably is constructed of steel or aluminum rods. The rack assembly 9 has two or more rods 10 extending in the direction of the flow of the dishes passing through the pre-wash station, and these rods 10 are turned down on each end so that when they sit in the basin, the upper surface of the rods forms a plane which is parallel to and essentially coinciding with the plane formed by the edges 2′, 3′, and 5′.

The rods 10 of the rack assembly are held together by rods extending transverse to the path of the dishes passing through the pre-wash station. These rods 11 are welded or otherwise connected to the rods 10 on the underside of the rods 10, and the end portions of the rods 11 again are turned down so that the entire rack assembly is supported by sitting in the bottom of the basin but the support for the rack assembly is such that a horizontal plane is established for the passage of dishes through the pre-wash station.

The rack assembly also has a guide 12 which extends along the back of the pre-wash station and may be connected to the assembly 9 by the extended portions of the guide 12' which are connected to the undersides of the rods 10. The guide 12 permits the operator of the pre-wash station to push the carriers 13 carrying the stacked dishes through the pre-wash station and directly into the commercial dishwashing unit with a minimum of effort.

At the back of the pre-wash station, adjacent the wall 3, is a 90° spray nozzle which sprays water out over a 90° area and the spray nozzle is directed toward the opening 7 in the bottom of the basin. The nozzle 14 is connected to a water supply and when the water supply is turned on, the spray from the nozzle will wash the waste material falling into the basin down the slant of the bottom of the basin 6 and into the opening 7 to be passed on to a disposal or strainer for collection of the waste material.

The nozzle assembly 15 is connected to a water supply, and the assembly includes a flexible hose 16 and a hand-actuated nozzle 17 which the operator may grasp and use to spray the dishes in the carrier 13 with a forced spray of water to scrape the soil off of any dishes passing through the pre-wash station.

If a strainer, such as the strainer 18 shown in FIG. 4, is contained in the unit, both the strainer and the rack assembly 9 may be easily lifted from the pre-wash station for cleaning of the bottom of the basin and for cleaning of the strainer and rack assembly after dishes have been pre-washed by use of my invention.

In operation, my invention functions as follows:

Dirty dishes from a restaurant or other commercial food preparation facility are stacked in a carrier such as carrier 13 shown in FIG. 1, for cleaning in both the pre-wash station and in the commercial dishwasher. These dishes usually are soiled with dried food and other waste material which may be difficult to remove by the standard commercial dishwashing unit. For this reason, a pre-wash station is normally required by state and local health officials. Once these dishes are stacked in the carrier 13, they pass along the dish table shown in phantom lines in FIG. 1, and the operator slides this carrier onto the rack 9. Once the carrier is in position on rack 9, the operator sprays the dishes with the nozzle 17, and the forced spray washes away any dried foodstuff and the like which may be caked onto the dishes. The bottom of the carrier 13 is essentially an open-mesh structure so that the soil material may flow downwardly through the bottom of the carrier and out of the carrier into the basin of the pre-wash station.

The rods 10 which extend in the direction of flow of the dishes in the carrier 13, are at the same height horizontally as is the level of the dish table so that the carrier 13 may be passed along the table directly onto the rack 9 without the operator having to lift the carrier or lower the carrier into the basin. Once the carrier is in position over the pre-wash station, the foodstuff passing through the bottom of the carrier will flow directly into the basin because of the open structure of the rack 9, and the use of the rod-like members 10 prevents any of the soil washed from the dishes from catching on the upper surface of these members and being pushed by the bottom of the carrier into the dishwashing unit.

Once the dishes have been sprayed sufficiently to wash off any caked waste material that may have existed, the carrier 13 is pushed by the operator into the opening of the commercial dishwasher over the vertical wall 3 of the pre-wash station. The vertical wall 3 also acts as a barrier to prevent any soil material that may have been washed from the dishes from passing into the commercial dishwasher. Since the height of the wall 3 and the height of the plane formed by the rack 9 coincides, the bottom of the carrier 13 is scraped on the upper edge 3' of the wall 3, and any foodstuff that may have collected on the underside of the carrier 13 is scraped from the carrier and remains in the pre-wash station as opposed to flowing into the commercial dishwashing system.

Every aspect of the present invention is designed to limit the amount of soil material which enters the commercial dishwashing unit so as to limit the amount of detergent that is necessary for operation of the dishwashing unit.

After use of the pre-wash station of the present invention, the clean-up time for the pre-wash station is minimal since the rack 9 can be lifted from the basin without having to disconnect any screws or other attachments and the bottom of the basin reached and cleaned with no obstruction. In addition, the rods of the rack 9 may be wiped down with a freedom not found in the cleaning of other pre-wash stations.

The spray nozzle 14 also assists in keeping the pre-wash station cleaned during the pre-washing operation, since the constant spray of water at a 90° angle along the plane of the bottom 6 of the basin forces any waste material dropping into the basin to flow down to the opening 7 and into a strainer or garbage disposal that may be attached thereto. Oftentimes, in the prior systems, where the only water coming into the pre-wash station is from a nozzle such as the nozzle 14, there is insufficient amount of water coming into the basin of the pre-wash station to cause the waste material to flow out the opening contained in the basin. As a consequence, in prior art systems, it is often necessary to stop the pre-wash activities and use some additional effort to clean the basin, whereas with the system of the present invention, that delay is eliminated by virtue of the additional water coming into the system through the spray nozzle 17. Also, the water from the combined spray nozzle gives the additional amount of liquid that is often necessary for the waste material to be able to pass through a garbage disposal that would be connected to the opening 7.

Having described the preferred embodiment of my invention, I claim:

1. A pre-wash station for use in commercial dishwashing operations where dishes stacked in a carrier are passed through the pre-wash station and sprayed with a forced spray of water, including:

a. a basin having vertical side walls with each side wall having an upper edge and a lower edge;

b. the upper edges of one set of opposing side walls form a first horizontal plane;

c. the lower edges of one set of connected side walls being askew to the upper edges of said side walls, respectively, d. said basin having a bottom integrally connected to the lower edges of said side walls and askew to the said horizontal plane;

e. an outlet formed in the bottom of said basin at the lower portion of said basin;

f. a rack sitting in said basin and supported by the bottom of the basin;

g. said rack including support rods extending in the direction of travel of a dish carrier passing through the pre-wash station, said rods in a position to form a second horizontal plane coinciding with the first horizontal plane, vertically extending means connected to said rods for supporting said rods at said position, and connecting rods connecting said support rods and attached to the underside of said support rods, h. one of said vertical walls being substantially perpendicular to the opposing walls whose upper edges form said first plane and extending vertically above the said plane to form a backsplash;

i. a spray assembly connected to said backsplash;

j. said spray assembly including a flexible hose and a hand-actuated spray nozzle;

k. the upper edge of one of said opposing walls being connected to a turned-down lip, and l. a wide angle spray nozzle in the bottom of said basin directed in the direction of the plane of the bottom.

2. A pre-wash assembly as claimed in claim 1 wherein the wide angle nozzle is closely adjacent the backsplash and the wall having the turned-down lip.

3. A pre-wash assembly as claimed in claim 1 wherein a strainer is movably positioned within said opening.

4. A pre-wash assembly as claimed in claim 1 wherein the height of the backsplash is equal to the front to back depth of the basin.

* * * * *